US008454761B1

(12) United States Patent
Esson

(10) Patent No.: US 8,454,761 B1
(45) Date of Patent: Jun. 4, 2013

(54) APPARATUS AND SYSTEM FOR CLEANING BASEBALL BASES

(76) Inventor: Fermin Esson, Loxahatchee, FL (US)

( * ) Notice: Subject to any disclaimer, the term of this patent is extended or adjusted under 35 U.S.C. 154(b) by 0 days.

(21) Appl. No.: 13/332,776

(22) Filed: Dec. 21, 2011

(51) Int. Cl.
*B08B 5/00* (2006.01)

(52) U.S. Cl.
USPC ..... 134/34; 15/339; 15/405; 134/18; 134/21; 134/31; 134/37; 134/42

(58) Field of Classification Search
USPC ..... 15/339, 405; 134/18, 21, 31, 34, 134/37, 42
See application file for complete search history.

(56) References Cited

U.S. PATENT DOCUMENTS

| | | | | |
|---|---|---|---|---|
| 1,868,088 | A | 8/1928 | Blair | |
| 2,103,148 | A | 4/1937 | Conrad | |
| 2,471,736 | A | 5/1947 | Fleming et al | |
| 4,007,026 | A | 2/1977 | Groh | |
| 4,174,204 | A | 11/1979 | Chase | |
| 4,200,950 | A * | 5/1980 | Coverley | 15/314 |
| 5,902,414 | A * | 5/1999 | Keal et al. | 134/37 |
| 2003/0171170 | A1 | 9/2003 | Tarng | |
| 2004/0016076 | A1 | 1/2004 | Gautschi | |
| 2004/0200027 | A1 | 10/2004 | Sugihara | |
| 2005/0179774 | A1 | 8/2005 | Fletcher et al. | |
| 2005/0241100 | A1 * | 11/2005 | Park | 15/330 |
| 2006/0042036 | A1 | 3/2006 | Quinn | |
| 2008/0069703 | A1 * | 3/2008 | Beckman | 417/307 |
| 2009/0126564 | A1 | 5/2009 | Maguire | |
| 2012/0255585 | A1 * | 10/2012 | Kowalczyk | 134/37 |

FOREIGN PATENT DOCUMENTS

EP 0816569 A2 * 7/1998

* cited by examiner

*Primary Examiner* — Bibi Carrillo
(74) *Attorney, Agent, or Firm* — Carol N. Green, Esq.

(57) ABSTRACT

An apparatus for cleaning the surface of a base, comprising: a base; a plurality of apertures flush with the surface of said base, said apertures being connected to a plurality of sub-channels and wherein said apertures are adapted to expel air; at least one air chamber operatively connected with said plurality of sub-channels; a main channel connected with said at least one air chamber; wherein said main channel is supplied from an air compressor; and a main valve located between said at least one air chamber and said main channel, wherein said main valve regulates the air flow from said main channel to said at least one air chamber, said valve being further adapted to close said main channel.

18 Claims, 5 Drawing Sheets

APPARATUS AND SYSTEM FOR CLEANING BASEBALL BASES

FIELD OF THE INVENTION

The present invention is generally related to an apparatus and system for cleaning baseball field bases and/or locations.

BACKGROUND OF THE INVENTION

During a baseball game, a player or players may slide onto bases in their bid to score home runs. In doing so, dirt, dust, debris and/or mud would normally end up on the base in question. In many instances, the game would have to be delayed because the umpire and/or cleaners would have to stop the game to go to the base to clean it. Additionally, as the game progresses, the base may accumulate dust and debris that land on the base. As a result, the base ends up being dirtied and hard to see over time by both players and umpires. Clean bases are needed as they are more visible by the players and most especially the umpires who need to make play calls.

As such, there is a need for an apparatus and system that would enable the efficient cleaning of the base thereby enabling players to see the base as they slide or dive toward it. There is also a need for an apparatus and system that enables remote cleaning of the base, which would obviate the need for an umpire and/or a cleaner to go out to the base during a game to clean the base.

SUMMARY OF THE INVENTION

It is an object of the present invention to provide an apparatus, system and method for cleaning the surface of a baseball field base where the apparatus may comprise of a base, and one or more apertures which are positioned within the base. In one aspect of an embodiment of the present invention, the apertures may be adapted to expel air and may also be connected to one or more sub-channels. In another aspect of an embodiment of the present invention, the one or more apertures may be positioned flush with the surface of the base. The envisioned apparatus may also comprise of one or more air chambers which are operatively connected with the one or more sub-channels. The apparatus may further comprise of a main channel connected with the one or more air chambers, where the main channel is supplied from an air compressor. The apparatus may also comprise of a main valve located between the one or more air chambers and the main channel, where the main valve regulates the air flow from the main channel to the one or more air chambers. The valve may also be further adapted to close the main channel.

In one aspect of an embodiment of the present invention, one or more sides of the base may comprise of a visual display. The visual display may be a variety of things, including, without limitation, an LED display, an advertising screen etc. or combination thereof. The visual display may also perform a variety of functions.

In one aspect of an embodiment of the present invention, the surface of the base may comprise of sensors which detect dust, debris and/or mud on the base. In another aspect of an embodiment of the present invention, the sensors may be adapted to effect a blast of air from the air compressor. In an alternate embodiment, the sensors may be programmed to activate the air compressor once a certain amount of dust, debris, mud etc. has been detected on the surface of the base.

In another aspect of an embodiment of the present invention, the air compressor may be programmed to supply air at predetermined times. As such, the air compressor may operate either independently of input or with input from a user using the apparatus or operating the system.

In yet another aspect of an embodiment of the present invention, the base may further comprise of a visual device for aiding a user in determining when to activate the air compressor. In yet another aspect of an embodiment of the present invention, the visual device may be used to detect the presence of dust, debris and/or mud on the base.

In a further aspect of an embodiment of the present invention, the one or more apertures may be positioned to ensure efficient cleaning of the base. In one embodiment, the apertures are inclined at different angles to effect direct and indirect air blasts to clean the base.

In another aspect of an embodiment of the present invention, a base cleaning system is envisioned. The system, in one aspect of an embodiment, may comprise of an air compressor, a controller, one or more bases, a plurality of conduits or channels used to supply air to the bases. In one aspect of an embodiment of the invention, the controller may be either stationary or wireless. In another aspect, the air compressor may operate at predetermined intervals. In another aspect, the predetermined intervals may be programmed at the controller.

In another aspect of an embodiment of the present invention, a method of operating a system for cleaning baseball locations is disclosed. In one aspect, the method may include the steps of detecting dust, debris, dirt, mud or other obstacles at one or more locations, activating an air compressor to supply air to the one or more locations, directing air from the air compressor to the one or more locations, regulating the flow of said supplied air at the one or more locations, and using the supplied air to clean the one or more locations.

In another aspect of an embodiment of the present invention, the method may further include the step of monitoring the one or more locations. This may be made possible by using a variety of visual devices including cameras.

In another aspect of an embodiment of the present invention, the method may further include the step of activating a pre-determined schedule for supplying air to the one or more locations.

In another aspect of an embodiment of the present invention, the method may further include the step of displaying information at the one or more locations.

In another aspect of an embodiment of the present invention, the method may further include the step of effecting an automatic blast of air at the one or more locations upon the detection of dust, debris, dirt, mud or other obstacles. In one aspect, detection of dust, dirt, debris or other obstacles may be made possible using a variety of sensory devices including, without limitation, infra-red devices.

In another aspect of an embodiment of the present invention, the method may further include the step of transmitting an activation signal wirelessly.

BRIEF DESCRIPTION OF THE DRAWINGS

The features and advantages of aspects of embodiments of the present invention will become more apparent from the detailed description set forth below when taken in conjunction with the claims and drawings, in which like reference numbers indicate identical or functionally similar elements. Additionally, the left-most digit of a reference number identifies the drawing in which the reference number first appears.

DETAILED DESCRIPTION OF THE PREFERRED EMBODIMENT

The present invention is now described in more detail by reference to the exemplary drawings in detail wherein like numerals indicate like elements throughout the various views. This is for convenience only and is not intended to limit the application of the present invention. In fact, after reading the following description, it will be apparent to one skilled in the relevant art(s) how to implement the following invention in alternate embodiments.

Figure 1:
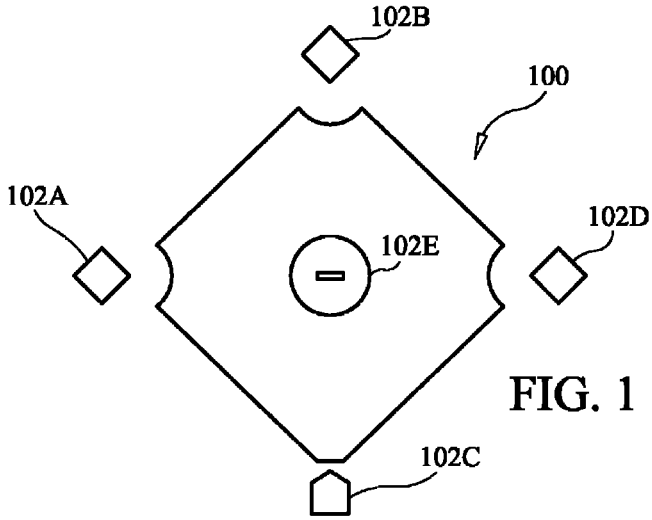
FIG. 1 illustrates a general layout of a baseball field showing the field's bases according to an exemplary aspect of the present invention.

Referring now to FIG. 1, a general layout of a baseball field 100 according to an exemplary aspect of the present invention is shown. As seen, baseball field 100 has three regular bases 102A, 102B, 102C, home base 102D and pitcher's mound 102E ("locations") where all of these bases and the pitcher's mound may have the same configuration and structural form or makeup. It should be noted that the number of locations may vary or differ and may include other positions not identified as "bases" or "pitcher's mound."

Figure 2A:
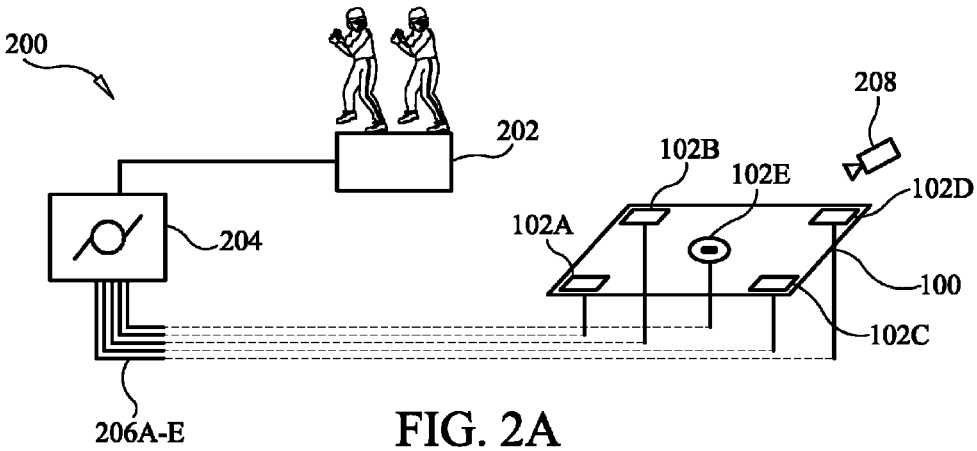
FIG. 2A illustrates a system according to an exemplary aspect of the present invention showing a fixed controller device & location.

Referring now to FIG. 2A, a system 200 according to an exemplary aspect of the present invention showing a fixed controller device & location 202 is shown. Here, fixed controller device & location 202 is used to control the operation of air compressor 204. In one aspect of an embodiment of the present invention, an operator (e.g. an umpire and/or cleaner) may activate the air compressor 204 once the operator realizes that a base or some bases have been obscured by dirt, debris and/or mud. In another aspect of an embodiment of the present invention, the dust, dirt, mud and/or obstacles may be detected using a variety and/or combination of sensors and monitoring devices any one of which may use infra-red technology. Once air compressor 204 is activated, it sends a supply of air through conduits 206A-206E to bases 102A through 102D and pitcher's mound 102E of baseball field 100. In one aspect of an embodiment of the present invention, a visual device 208 may be strategically positioned to view bases 102A through 102D and pitcher's mound 102E. As such, an umpire or cleaner would be able to readily determine whether a base or bases need to be cleaned or not. Visual device 208 may send its video feed back to fixed controller device & location 202 or to any designated location.

Figure 2B:
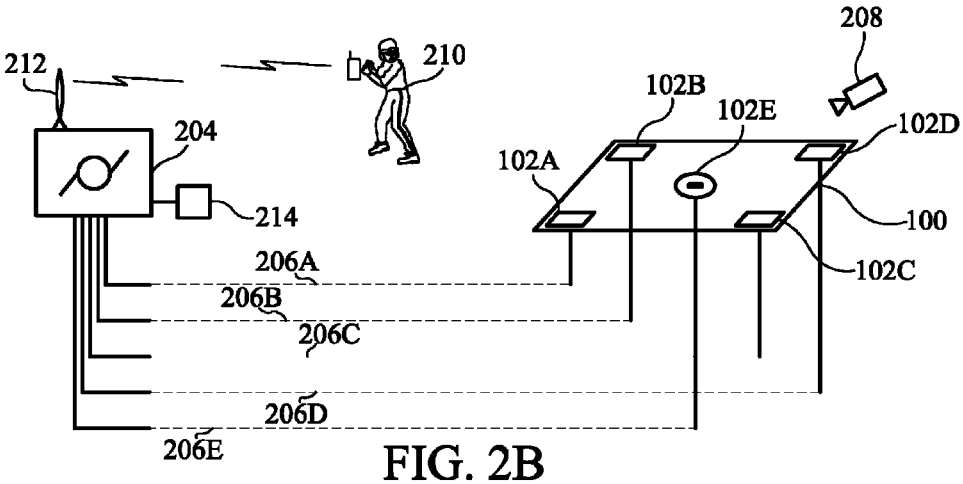
FIG. 2B illustrates a system according to an exemplary aspect of the present invention showing the use of a wireless controller.

Referring now to FIG. 2B, an exemplary aspect of the present invention showing the use of a wireless controller 210 is shown. Here, the air compressor 204 may be controlled and/or activated by a wireless controller 210. An operator may be anywhere with the wireless controller 210 which transmits a signal to data receiver 212 which may be in operative communication with air compressor 204. Data receiver 212 then sends the desired control to air compressor 204. In one aspect, the control may be for air compressor 204 to supply only one base or any number of bases 102A-102D and/or pitcher's mound 102E with air to clean their respective surfaces. In another aspect of an embodiment of the present invention, air compressor 204 may be activated at predetermined intervals. Air compressor 204 may also be pre-programmed to operate at certain designated times on a predetermined schedule.

In another aspect of an embodiment of the present invention, a smoke generator 214, may be connected with air compressor 204. As such, wireless controller 210 may send a signal for smoke generator 214 to generate smoke and send it to a base, desired base(s) and/or pitcher's mound 102E through air compressor 204. In another aspect of an embodiment of the present invention, a visual device 208 may also be present. In one aspect of an embodiment of the present invention, visual device 208 may be part of a base 102. In another aspect of an embodiment of the present invention, visual device 208 may be a separate device from base 102. Visual device 208 may aid an operator or user in determining when to activate the air compressor. In yet another aspect of an embodiment of the present invention, the visual device may also be used to detect the presence of dust, debris and/or mud on the base. In a further aspect of an embodiment of the present invention, visual device 208 may be used to monitor the accumulation and/or detection of dust, debris, mud or obstacles at the base.

Figure 3A:
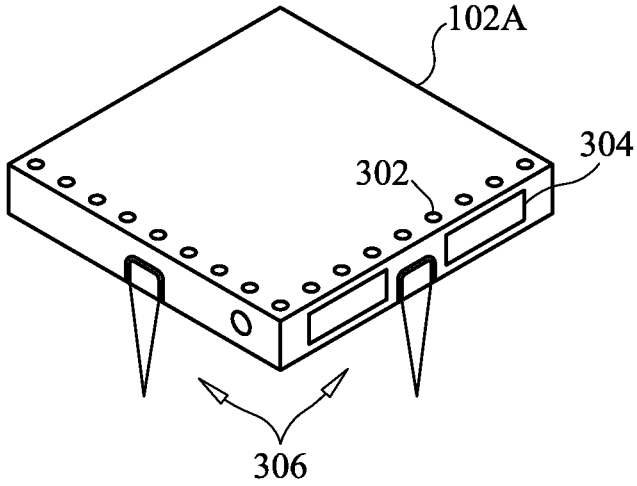
FIG. 3A illustrates a perspective view of a base according to an exemplary aspect of the present invention.

Referring now to FIG. 3A a perspective view of a base 102A according to an exemplary aspect of the present invention is shown. Here a plurality of apertures 302 is shown on the surface of base 102A. It should be noted that discussion/description of the invention as it pertains to base 102A is purely illustrative and not limiting as the same discussion/description may be applicable to bases 102B-102D, pitcher's mound 102E and/or any other location in the system. In one aspect of an embodiment of the invention, the apertures 302 may be equidistant from each other. In another aspect, the apertures 302 may be at random positions from each other. In yet another aspect, apertures 302 may be positioned to ensure cleaning of the surface of base 102A including the positions between apertures. In yet another aspect, apertures 302 may be positioned at angular positions to ensure blasts of air at angles to clean the surface and also to collide and bounce back onto spots in between apertures 302. In yet another aspect of the invention, the apertures 302 are positioned flush with the surface of base 102A. In yet another aspect of an embodiment of the present invention, base 102A is also installed in its position using ground supports 306 as shown.

Figure 3B:
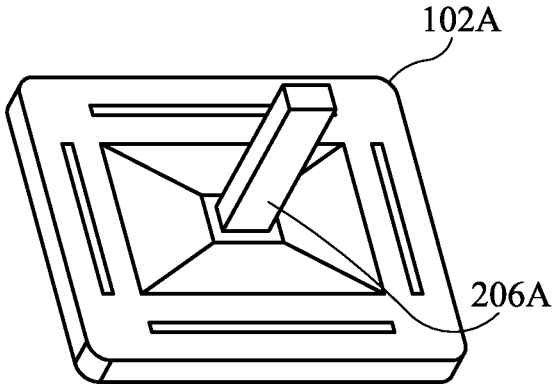
FIG. 3B illustrates a bottom view of a base according to an exemplary aspect of the present invention.
Figure 3C:
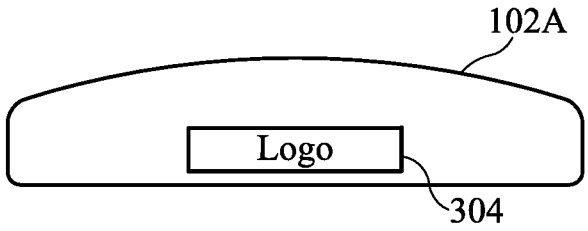
FIG. 3C illustrates a side view of a base according to an exemplary aspect of the present invention.

Also seen in FIGS. 3A & 3C is visual display 304. Visual display 304 may be a variety of things, including, without limitation, an LED display, an advertising screen etc. or combination thereof. Visual display 304 may also perform a variety of functions, including a display of a team's logo as shown in FIG. 3C. In another aspect of an embodiment of the present invention, visual display 304 may have a ticker tape with displayed advertisements.

Referring now to FIG. 3B, a bottom view of a base 102A according to an exemplary aspect of the present invention is shown. Here conduit 206A is shown entering base 102A from the bottom. Conduit 206A supplies air from air compressor 204 once air compressor 204 has been activated to operate and supply air to one or any number of bases 102A-102D and/or pitcher's mound 102E. Air then flows from conduit 206A into base 102A.

Figure 3D:
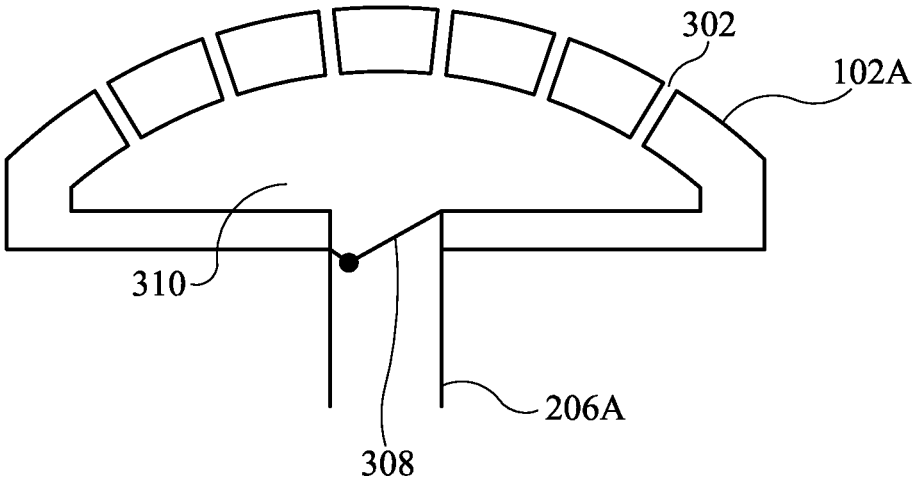
FIG. 3D illustrates a sectional view of a base according to an exemplary aspect of the present invention.

Referring now to FIG. 3D, a sectional view of a base 102A according to an exemplary aspect of the present invention is shown. As shown, conduit 206A supplies air from air compressor 204 passing through main valve 308, which, in one aspect of an embodiment of the present invention, may function to regulate the air flow top air chamber 310. Upon opening of main valve 308, the air flows into air chamber 310 before subsequently exiting base 102A via apertures 302, which in turn cleans the surface of base 102A. In one aspect of an embodiment of the present invention, the air supplied by air compressor 204 may remain in the conduit/conduits 206 until main valve 308, as shown in FIG. 3D opens. The operation of main valve 308 may be automatic or manual. In another aspect of an embodiment of the present invention, main valve 308 may be controlled from controller device 202. Once main valve 308 is opened, air flows into air chamber 310. In another aspect of an embodiment of the present invention, there may more than one air chamber. In a further aspect, each air chamber may be supplied separately by a separate conduit or air channel while also having individual valves to regulate the flow of air from air compressor 204. In a yet further aspect of an embodiment of the present invention, an automatic blast of air may be supplied to base 102A upon detection of dust, dirt, mud and/or obstacles on its surface.

Figure 4:
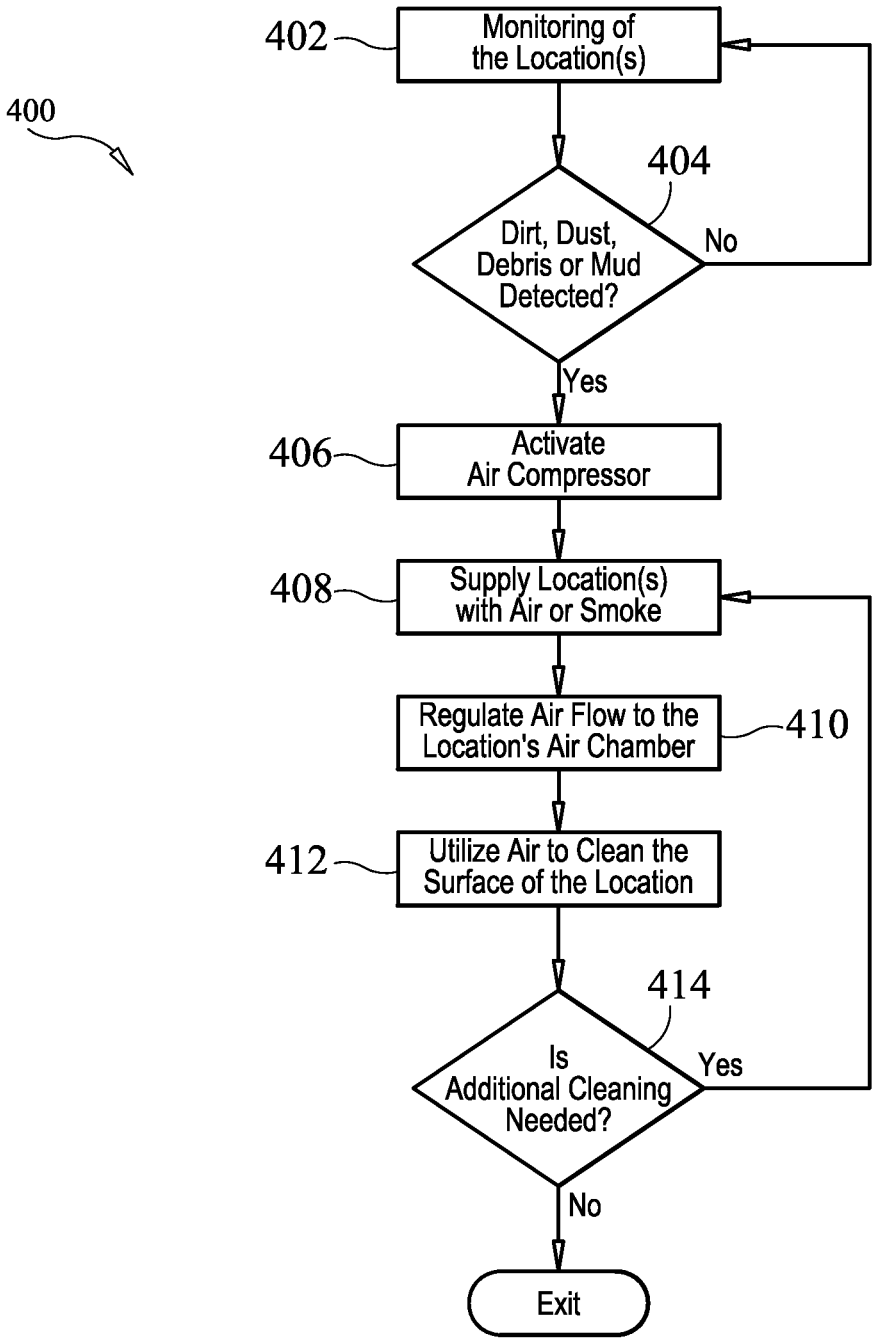
FIG. 4 illustrates a flow chart of an operational process flow according to an exemplary aspect of the invention.

Referring now to FIG. 4, a flowchart showing an operational process flow 400 according to an aspect of an embodiment of the present invention is shown. The process may begin in step 402 with the monitoring of the bases or locations. Monitoring, in one aspect of an embodiment of the present invention, may be implemented by a visual device such as visual device 208. Following the monitoring of the location(s) in step 402 is step 404 where it is determined whether the monitored location(s) is obscured by dirt, dust, debris, mud and/or other obstacles. An umpire or operator viewing the video feed from visual device 208 may, in step 404, determine that a certain location may need to be cleaned. Once this has been determined, air compressor 204 may be activated in step 406 to start supplying air to the location. Once activated, air compressor 204 then supplies the designated location(s) with a blast/supply of air or smoke as shown in step 408. Upon reaching the designated location, the air flow to the location's air chamber 310 may be regulated by main valve 308, an operation as shown in step 410. The supplied air may then be utilized in step 412, upon release, to clean the surface of the location. Following this cleaning operation, the umpire and/or operator may, in step 414, make another determination as to whether the location needs additional cleaning or not. If additional cleaning is needed, the process proceeds back to step 406 with the umpire and/or operator activating air compressor 204 to supply more air to the location. If not, the process ends.

In one aspect of an embodiment of the present invention, the umpire and/or operator may activate air compressor 204 using controller device 202 or wireless controller 210. In another aspect of an embodiment of the present invention, air compressor 204 may be activated to supply the designated location with smoke generated by smoke generator 214. In another aspect of an embodiment of the present invention, LED display may be activated by controller device 202 or wireless controller 210 with the displayed information transmitted via wire and/or wirelessly.

Figure 5:
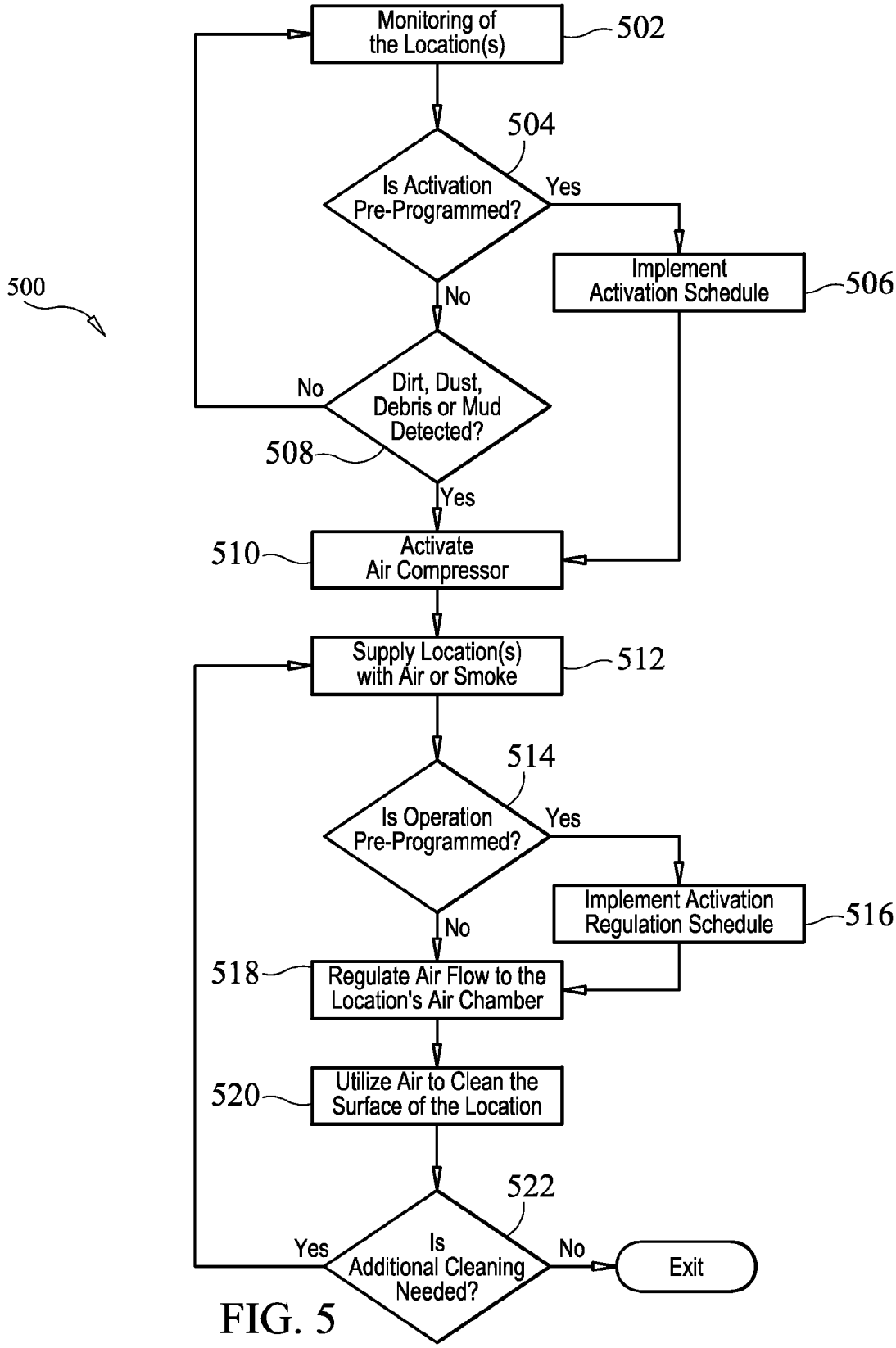
FIG. 5 Illustrates a flow chart of another operational process flow according to an exemplary aspect of the invention.

Referring now to FIG. 5, a flowchart showing another operational process flow 500 according to an aspect of an embodiment of the present invention is shown. The process may begin with the monitoring of the location(s) as shown in step 502. The process then proceeds to step 504 where the system determines whether the activation of air compressor 204 has been programmed into the system or not. If it is determined that activation of air compressor 204 has been programmed, the process proceeds to step 506 where the activation schedule for air compressor 204 is implemented. If no activation schedule has been pre-programmed for air compressor 204, then the process proceeds to step 508 where the monitor (be it either the umpire and/or an operator) makes a determination as to whether the location(s) require cleaning. If the answer to this decisional block is in the affirmative, then air compressor 204 is activated as shown in step 510. If not, then the process proceeds to step 502 for continued monitoring. An activation schedule may, in one aspect of an embodiment of the present invention, dictate when air compressor 204 is to be activated, duration of air compressor 204's operation, amount of air to be supplied etc.

Once air compressor 204 has been activated in step 510, air compressor 204 then supplies the designated location(s) with air as shown in step 512. In another aspect of an embodiment of the present invention, air compressor 204 may also supply, based on an umpire's/operator's selection, smoke as generated by smoke generator 214.

The system, in step 514 then determines whether operation of main valve 308 is pre-programmed into the system or not. In another aspect of an embodiment of the present invention, it may be determined in step 514 whether operation of main valve 308 is to be either pre-programmed (automatic) or manual. If operation of main valve 308 is determined to have been pre-programmed into the system (for example, at controller 202), the regulation schedule of main valve 308, in step 516, is then implemented. In one aspect, the regulation of main valve 308 may allow a certain amount of air flow into air chamber 310. In another aspect, main valve 308 may be opened or closed depending on the regulation schedule. If the operation is determined to not have been pre-programmed, then in step 518, main valve 308 regulates the air flow to air chamber 310 as air compressor 204 is activated under normal conditions.

The air flow into air chamber 310 is then used, in step 520 to clean the surface after which an umpire and/or operator in step 522 determines whether the surface is clean or whether additional cleaning is required. If it is determined that the surface is clean, the process ends. If not, the process proceeds to step 512 where air compressor 204 is further activated to supply air to the location for additional cleaning.

Although this present invention has been disclosed with reference to specific forms and embodiments, it will be evident that a great number of variations may be made without departing from the spirit and scope of the present invention. For example, steps may be reversed, equivalent elements may be substituted for those specifically disclosed and certain features of the present invention may be used independently of other features—all without departing from the present invention as defined in the appended claims.

What is claimed is:

1. A method of operating a system for cleaning baseball locations comprising the steps of:

a. detecting dust, debris, dirt and mud on at least one location or base that is operatively connected to at least one underground conduit;

b. activating an air compressor to supply air upward to said at least one location or base through the at least one underground conduit;

c. directing air from said air compressor to said at least one location or base;

d. regulating a flow of said supplied air at said at least one location or base;

e. providing an aperture positioned on said at least one location or base; and f. utilizing said supplied air to clean said at least one location or base and expelling said supplied air through said aperture.

2. The method of claim 1, further comprising the step of monitoring said at least one location or base.

3. The method of claim 1, further comprising, the step of supplying air to said at least one location or base on a predetermined schedule.

4. The method of claim 1, further comprising the step of displaying a visual display at said at least one location or base.

5. The method of claim 1, further comprising the step of supplying an automatic blast of air at said at least one location or base upon the detection of dust, debris, dirt and mud.

6. The method of claim 1, wherein the step of activating said air compressor further comprises the step of transmitting an activation signal wirelessly to the air compressor.

7. The method of claim 1, further comprises using sensors for detecting said debris, dust and mud on said at least one location or base.

8. The method of claim 1, wherein said at least one aperture is adaptively positioned to ensure cleaning of said at least one location or base.

9. The method of claim 1, wherein said at least one aperture is angularly inclined to effect direct and indirect air blasts to clean the at least one location or base.

10. The method of claim 1, further comprising controlling the operation of said air compressor by an entry transmitter.

11. The method of claim 1 further comprising using a wireless controller for activating said air compressor to supply said air to said at least one location or base.

12. The method of claim 1, further comprising generating smoke via a smoke generator that is connected to said air compressor for cleaning said at least one location or base.

13. The method of claim 2, further comprises of monitoring said at least one location or base by a visual device for aiding a user in determining when to activate the air compressor.

14. The method of claim 4, wherein said visual display is selected from the group consisting of an LED display, an advertising screen or a ticker tape.

15. The method of claim 4, further comprising activating the visual display by a controller device or a wireless controller.

16. The method of claim 4, further comprising transmitting data for the visual display either wired or wirelessly.

17. The method of claim 7, further comprising directing said air by blasting said air from said air compressor in response to said detecting step.

18. The method of claim 13, wherein said visual device is an element of said at least one location or base.

* * * * *